US009694932B2

(12) United States Patent
Lopez Masague

(10) Patent No.: US 9,694,932 B2
(45) **Date of Patent: *Jul. 4, 2017**

(54) STORAGE BOX

(71) Applicant: Embalajes Capsa, S.L., Canet de Mar (ES)

(72) Inventor: Manuel Lopez Masague, Canet de Mar (ES)

(73) Assignee: EMBALAJES CAPSA, S. L., Canet de Mar (ES)

( * ) Notice: Subject to any disclaimer, the term of this patent is extended or adjusted under 35 U.S.C. 154(b) by 0 days.

This patent is subject to a terminal disclaimer.

(21) Appl. No.: 15/046,068

(22) Filed: Feb. 17, 2016

(65) Prior Publication Data

US 2016/0159514 A1 Jun. 9, 2016

Related U.S. Application Data

(63) Continuation of application No. 14/660,506, filed on Mar. 17, 2015, now Pat. No. 9,272,806, which is a continuation of application No. 14/174,706, filed on Feb. 6, 2014, now abandoned, which is a continuation of application No. 12/600,076, filed as application No. PCT/IB2008/051898 on May 14, 2008, now Pat. No. 8,668,132.

(30) Foreign Application Priority Data

May 14, 2007 (ES) ..... 200701359

(51) Int. Cl.

| | |
|---|---|
| ***B65D 5/10*** | (2006.01) |
| ***B65D 5/36*** | (2006.01) |
| ***B65D 5/66*** | (2006.01) |
| ***B65D 21/032*** | (2006.01) |
| ***B65D 5/02*** | (2006.01) |

(Continued)

(52) U.S. Cl.

CPC ..... *B65D 5/106* (2013.01); *B65D 5/003* (2013.01); *B65D 5/0015* (2013.01); *B65D 5/0281* (2013.01); *B65D 5/103* (2013.01); *B65D 5/3621* (2013.01); *B65D 5/443* (2013.01);

(Continued)

(58) Field of Classification Search

CPC ..... B65D 5/106; B65D 5/443; B65D 5/0015; B65D 5/6685; B65D 5/003; B65D 5/6697; B65D 5/0281; B65D 5/6694; B65D 5/4608; B65D 5/103; B65D 5/3621

See application file for complete search history.

(56) References Cited

U.S. PATENT DOCUMENTS

| | | | |
|---|---|---|---|
| 2,060,240 | A | 11/1936 | Pergande |
| 2,308,050 | A | 1/1943 | Burr |

(Continued)

FOREIGN PATENT DOCUMENTS

| | | |
|---|---|---|
| GB | 942080 | 11/1963 |

*Primary Examiner* — Gary Elkins

(74) *Attorney, Agent, or Firm* — Edell, Shapiro & Finnan LLC

(57) ABSTRACT

The storage box is fanned from a sheet provided with a plurality of folding lines defining a parallelepiped provided with six faces. One of the faces is a hinged lid, and it is characterized in that the opposed face to the hinged lid comprises a first sector provided with an oblique folding line that defines a first joining zone. A second sector also provided with an oblique folding line that is joined to the first sector in the first joining zone; and a third sector is provided with an oblique folding line that defines a second joining zone; and a fourth sector that is joined to the third sector in the second joining zone.

18 Claims, 7 Drawing Sheets

(51) Int. Cl.
*B65D 5/468* (2006.01)
*B65D 5/00* (2006.01)
*B65D 5/44* (2006.01)

(52) U.S. Cl.
CPC ..... *B65D 5/4608* (2013.01); *B65D 5/6685* (2013.01); *B65D 5/6694* (2013.01); *B65D 5/6697* (2013.01)

(56) References Cited

U.S. PATENT DOCUMENTS

| | | | | |
|---|---|---|---|---|
| 2,319,924 | A | 5/1943 | Ferguson | |
| 2,513,079 | A | 6/1950 | Buerger | |
| 3,201,026 | A | 8/1965 | Travis et al. | |
| 3,240,418 | A | 3/1966 | Elias | |
| 3,659,772 | A | 5/1972 | Dorsey et al. | |
| 4,013,213 | A | 3/1977 | Giebel | |
| 4,027,818 | A | 6/1977 | Stoll | |
| 4,289,268 | A | 9/1981 | Paige | |
| 4,373,660 | A | 2/1983 | Wytko | |
| 4,709,852 | A | 12/1987 | Stoll | |
| 5,390,847 | A | 2/1995 | Young | |
| 5,887,782 | A | 3/1999 | Mueller | |
| 5,927,593 | A | 7/1999 | Berkowitz et al. | |
| 6,926,192 | B1 | 8/2005 | Dowd | |
| 8,668,132 | B2 * | 3/2014 | Lopez Masague .... | B65D 5/103 229/117 |
| 9,272,806 | B2 * | 3/2016 | Masague ..... | B65D 5/103 |
| 2005/0011938 | A1 | 1/2005 | West | |

* cited by examiner

STORAGE BOX

CROSS REFERENCE TO RELATED APPLICATIONS

This application is a continuation of U.S. patent application Ser. No. 14/660,506 filed Mar. 17, 2015, which is a Continuation of U.S. patent application Ser. No. 14/174,706 filed Feb. 6, 2014, now abandoned, which is a Continuation of U.S. patent application Ser. No. 12/600,076, filed Nov. 13, 2009, which issued as U.S. Pat. No. 8,668,132, on Mar. 11, 2014, which is the U.S. National Phase of PCT/IB2008/051898, filed May 14, 2008, the entire contents of which are hereby incorporated by reference. International Application No. PCT/IB2008/051898 claims benefit under the Paris Convention to Spanish Application P-2007/01359 filed May 14, 2007. The disclosures of both P-2007/01359 and PCT/IB2008/051898 are hereby incorporated herein by reference in their entirety.

FIELD OF THE INVENTION

The present invention relates to a storage box that is provided with a lid.

BACKGROUND

Storage boxes that are used for storing files, or for storing other objects are already known. These boxes are usually made from cardboard and comprise a hinged lid.

These storage boxes already known are usually formed from a sheet provided with a number of folding lines, so that by a mounting process the box is obtained and it is ready for its use.

The main problem of these already known boxes is that the sheet that is provided to the user unfolded takes up a substantial space, so it is uncomfortable to mount them.

Furthermore, these boxes usually have also a resistance problem, mainly when they are stacked to each other.

Another drawback that some of these boxes present is that it is necessary to use an external closing element to close the lid, such as e.g. adhesive tape.

SUMMARY

With the storage box of the invention said drawbacks can be solved, presenting other advantages that will be described.

The storage box of the present invention is formed from a sheet provided with a plurality of folding lines defining a parallelepiped provided with six faces, one of said face being a hinged lid, characterised in that the opposed face to said hinged lid comprises: a first sector provided with an oblique folding line that defines a first joining zone; a second sector also provided with an oblique folding line that is joined to said first sector in said first joining zone; a third sector provided with an oblique folding line that defines a second joining zone; and a fourth sector that is joined to said third sector in said second joining zone.

In view of this feature, the storage box of the present invention, that is provided with a lid, can be mounted by itself, i.e. it is provided to the user with said sectors defining the rear face joined to each other as stated previously, so that the box can be provided to the user in its folding position occupying a reduced space, and the user can mount the box easily and quickly.

According to a preferred embodiment, said first sector has a trapezoidal shape, said oblique folding line defining two triangular zones, said second sector has a substantially rectangular shape, said oblique folding line defining a triangular zone and a trapezoidal zone, said third sector has a trapezoidal shape, said oblique folding line defining two triangular zones, and said fourth sector has a trapezoidal shape.

To obtain a more resistant box, two or three of its faces comprise preferably reinforcing sectors that are folded on the respective side faces. Furthermore, the reinforcing sectors comprise flaps that in the mounting position of the box are in contact with the face opposed to the lid.

According to a first embodiment, to close the box, said front face comprises a closing flap that is housed inside a complementary groove provided at an additional flap of the upper face.

Preferably, said closing flap comprises a folding line that divides said closing flap into two.

One of said halves of the closing flap comprises a protrusion that is housed inside an additional groove provided in said additional flap.

Said upper face also comprises a joining flap that, in the mounting position of the box, is joined to the upper part of the adjacent face.

To stack the boxes of the present invention one on the other, the boxes comprise protrusions at their upper part, that are housed inside complementary recesses of the upper box when they are stacked one on the other.

The storage box is made preferably from corrugated cardboard, the channels of the corrugated cardboard being placed in a vertical direction with respect to its use position. Therefore, it is obtained a greater resistance of the box to the compression, particularly when they are stacked one on the other.

According to a second embodiment, the lid is formed by two hinged sectors engageable to each other.

Advantageously, said hinged sectors engageable to each other comprise complementary flaps.

According to a third embodiment, the storage box of the present invention comprises reinforcing flaps around the lid.

BRIEF DESCRIPTION OF THE DRAWINGS

For a better understanding of what has been disclosed some drawings are attached in which, diagrammatically and only as a non-limitative example, a practical case of embodiment is shown.

DETAILED DESCRIPTION

Figure 1:
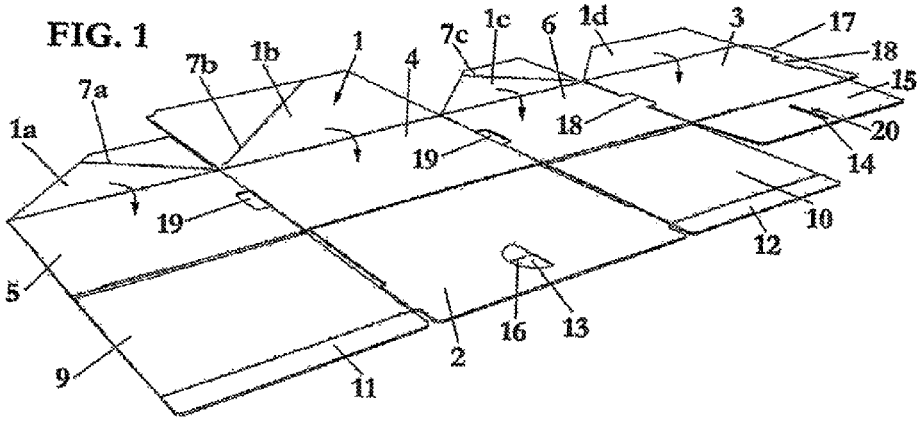
FIG. 1 is a perspective view of the sheet of the storage box of the present invention completely unfolded, according to a first embodiment.

As it can be seen from FIGS. 1-10, the storage box of the present invention is made from a sheet, preferably a corrugated cardboard, provided with a number of folding lines.

Said folding lines define a parallelepiped provided with a rear face 1, a front face 2, an upper face 3, a lower face 4 and two side faces 5, 6, such as it will be described hereinafter.

Firstly, it must be pointed out that the definition of said face is carried out according to the position they occupy during the normal use of the storage box, such as it is shown in the drawings. However, it is apparent that if a user rotates the box, the definition of said faces could change and, e.g. the rear face could be the lower face, as it happens in the second and third embodiments that will be described later.

The rear face, indicated generally by numeral reference 1, comprises: a first sector 1*a* provided with an oblique folding line 7*a* defining a first joining zone 8*a*; a second sector 1*b* also provided with an oblique folding line 7*b* that it is joined to said first sector 1*a* in said first joining zone 8*a*; a third sector 1*c* provided with an oblique folding line 7*c* defining a second joining zone 8*c*; and a fourth sector 1*d* that is joined to said third sector 1*c* in said second joining zone 8*c*.

Figure 2:
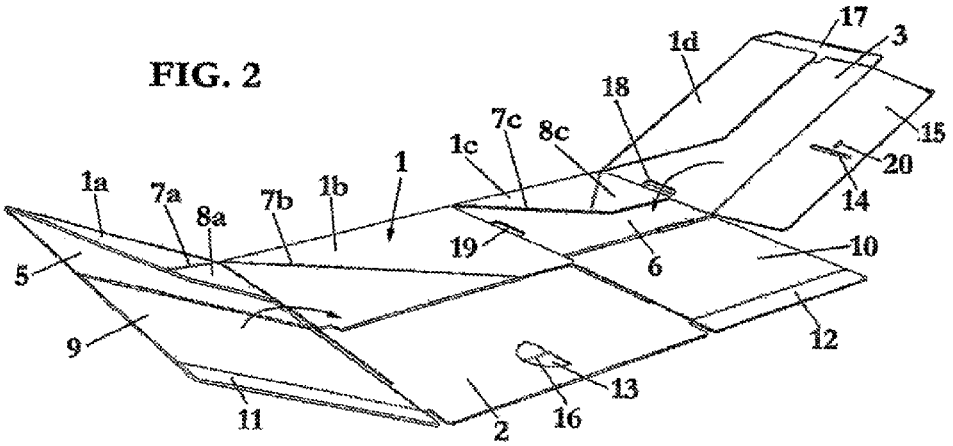
FIGS. 2-9 are perspective view of the sheet of the storage box of the present invention during the mounting process of the box, according to a first embodiment.

It must be pointed out that the sectors are not joined in FIGS. 1 and 2, wherein the sheet is shown in a preliminary phase before the delivery to the user to mount and use it. These two figures are of the manufacturing step of the box, as it will be explained hereinafter.

According to the embodiment shown, said first sector 1*a* has trapezoidal shape, said oblique folding line 7*a* defining two triangular zones, said second sector 1*b* has a substantially rectangular shape, said oblique folding line 7*b* defining a triangular zone and a trapezoidal zone, said third sector 1*c* has a trapezoidal shape, said oblique folding line 7*c* two triangular zones, and said fourth sector 1*d* has trapezoid shape.

Furthermore, said side faces 5, 6 comprise corresponding reinforcement sectors 9, 10, that fold on the respective side faces 5, 6, such as it will be described later during the description of the mounting process of the box of the present invention.

These reinforcing sectors 9, 10 comprise corresponding flaps 11, 12 that in the mounting position of the box are in contact with the rear face 1.

The front face 2 of the box of the present invention is a hinged lid, and said front face 2 comprises a closing flap 13 that is housed inside a complementary groove 14 provided at an additional flap 15 of the upper face 3.

The closing flap 13 comprises a folding line 16 that divides said closing flap 13 into two.

The upper face 3 comprises a joining flap 17 that, in the mounting position of the box, is joined to the upper part of the adjacent side face 5.

To permit said boxes to be stacked, said side faces 5, 6 comprise protrusions 18 at their upper part, that are housed into complementary recesses 19 of the upper box when they are stacked one on the other. As it can be seen in the figures, the protrusion 18 of one of said side faces 5 is placed in said joining flap 17.

Firstly, during the manufacturing step, when the sheet is completely unfolded (FIG. 1), the sectors 1*a*, 1*b*, 1*c*, 1*d* are folded on the side 5, lower 4, side 6 and upper faces, respectively, as it can be seen by the arrows represented in FIG. 1.

Then, the assembly of the side face 5 and the reinforcing sector 9 is folded on the rest of the sheet, and the upper face 3 is also folded on the rest of the sheet, as it can be seen by the arrows shown in FIG. 2.

During this folding is when the joining of the joining zones 8*a* and 8*c* on the respective sectors is carried out, and also the joining of the joining flap 17 with the side face 5. Said first and second joining zones 8*a*, 8*c* in the mounted position of the box are placed close to the opposed corners of said rear face.

Figure 3:
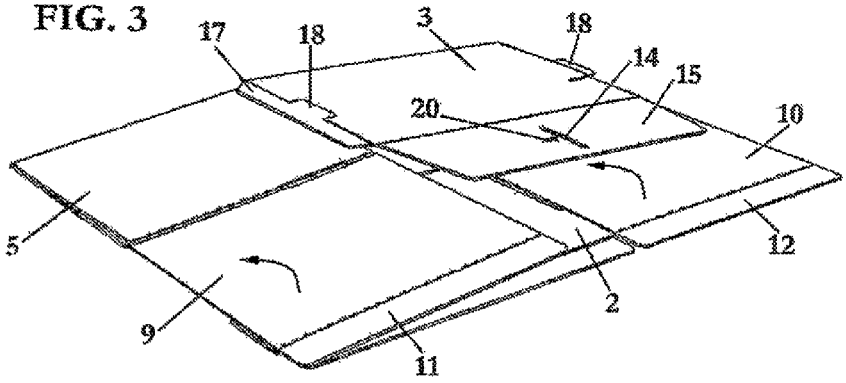
Figure 4:
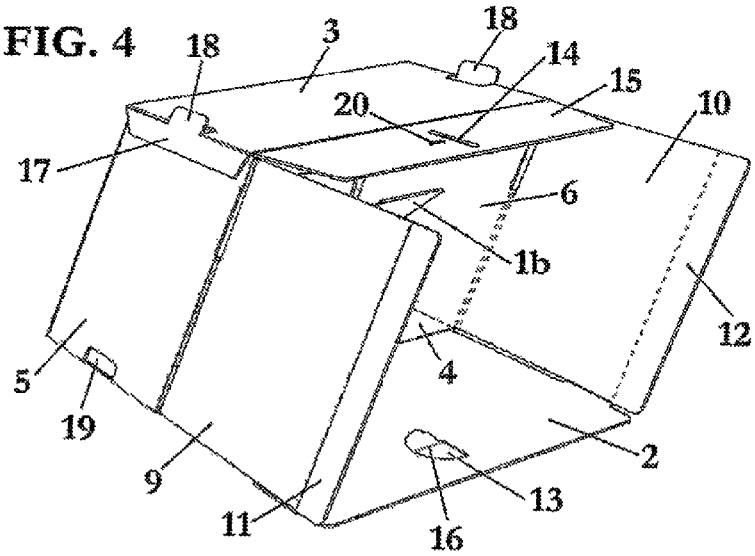

The box of the present invention is provided to the user in the folded position shown in FIG. 3. As it can be seen, the volume that the box occupies in the folded position is reduced, and its mounting is carried out in a quickly and comfortable way, as it will be described hereinafter.

Firstly, to mount the box of the present invention it is necessary to rotate the side face 5 and 6 in the direction of the arrows shown in FIG. 3.

The sectors of the rear face 1 are also folded, and they are placed atop of each other, the second sector 1*b* being placed at the internal part of said rear face 1.

Figure 5:
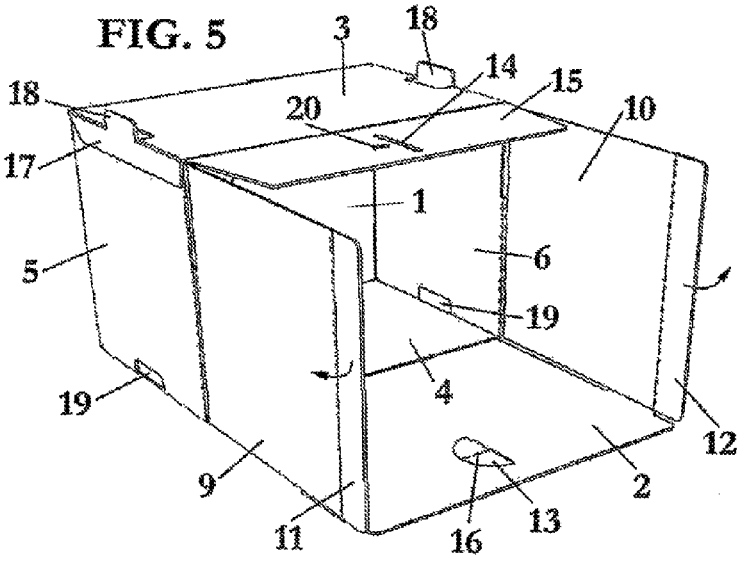
Figure 6:
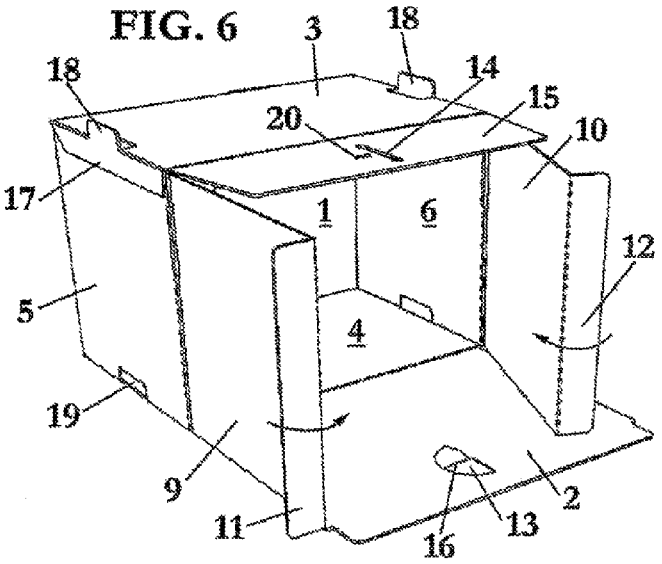

Once in this position, shown in FIG. 5, the flaps 11 and 12 of the reinforcing sectors 9 and 10 are folded outwardly (FIG. 6), and then the reinforcing sectors and 10 are folded inwardly (FIG. 7), so that the reinforcing sectors 9 and 10 are placed on the side faces 5 and 6, respectively, and the flaps 11 and 12 are placed on the rear face 1

Figure 7:
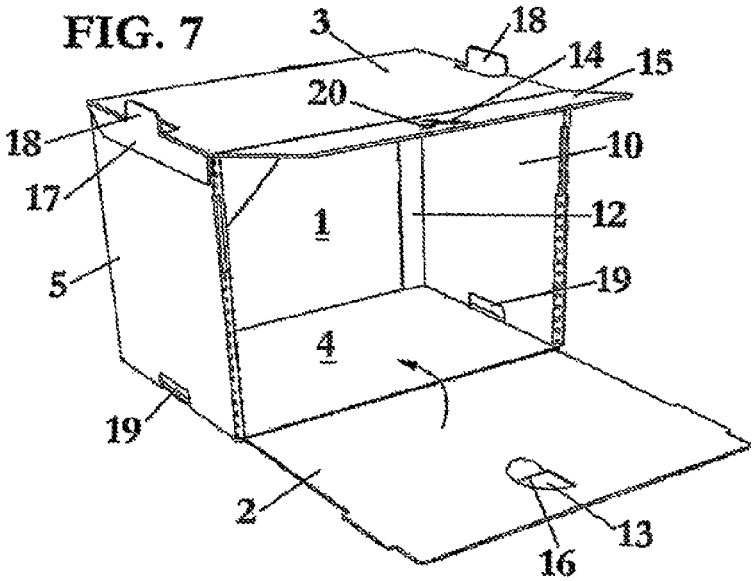
Figure 8:
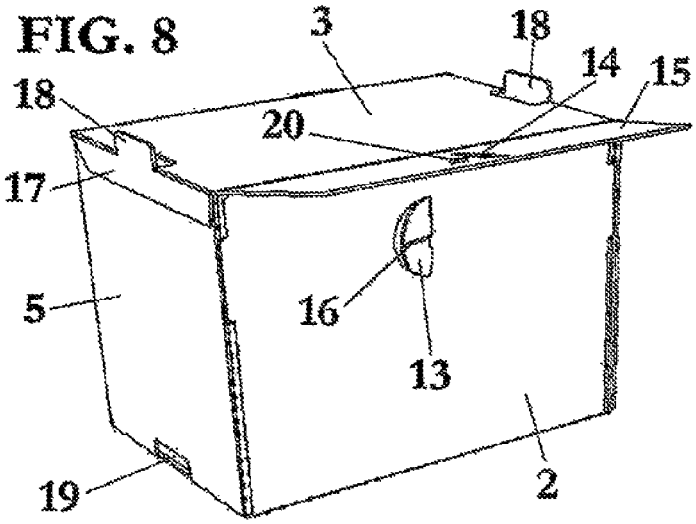
Figure 9:
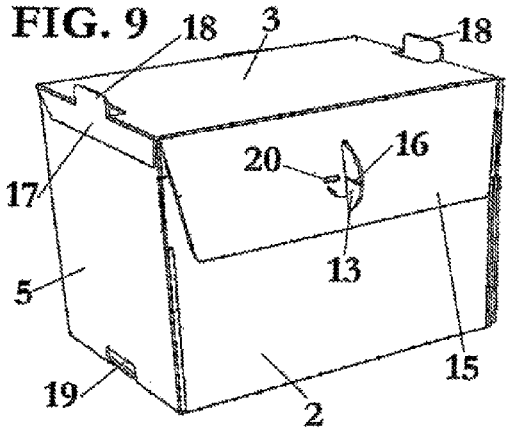
Figure 10:
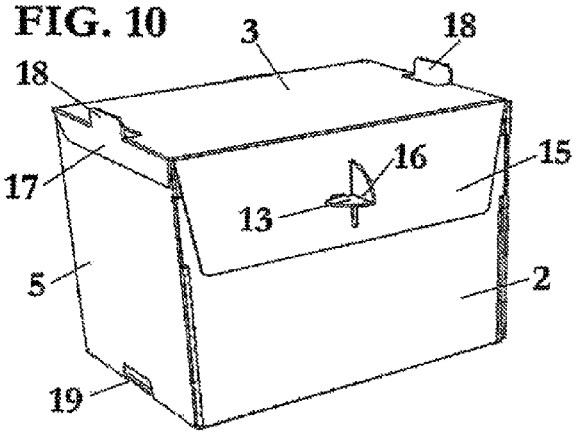
FIG. 10 is a perspective view of the storage box of the present invention in its mounted position, according to said first embodiment.

In this position, shown in FIG. 7, the corresponding files can be placed inside the box, and to close the lid or front face 2 it is rotated 90° towards the box, as it can be seen in FIG. 8.

Then, the additional flap 15 is folded on the front face 2, as it can be seen by the arrow shown in FIG. 8. Furthermore, the closing flap 13 is also folded, being substantially perpendicular with respect to the front face 2.

In this position, the closing flap 13 is housed inside the groove 14 provided at the additional flap 15, and the closing flap 13 is folded about its folding line 16, so that the lower half is folded upwardly (arrow shown in FIG. 9), a protrusion provided at said half being housed into an additional groove 20 also provided at said additional flap 15. Therefore, it is obtained a suitable closing element of the box of the present invention.

To enhance the resistance of the box, it is made preferably from corrugated cardboard, the own channel of the corrugated cardboard being placed in a vertical direction in the side faces.

Hereinafter two additional embodiments of the storage box of the present invention are described. For simplicity reasons the common elements are not described again, and similar reference numbers identify these common elements, specifically the reference numbers of the second embodiment are increased by 100 and by 200 the reference numbers in the third embodiment.

Figure 11:
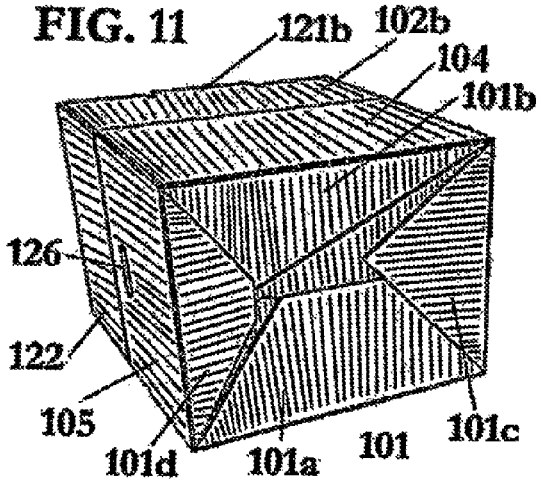
FIG. 11 is a bottom perspective view of the storage box of the present invention, according to a second embodiment.
Figure 12:
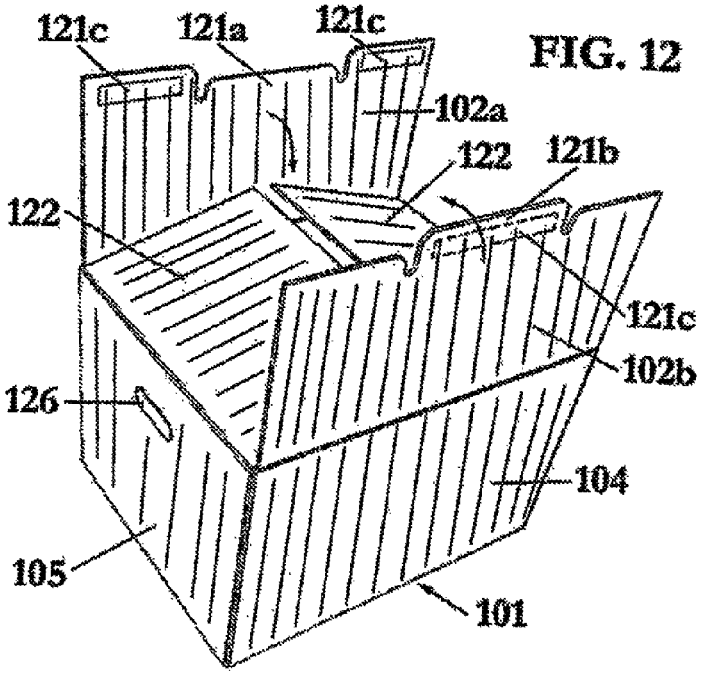
FIG. 12 is a top perspective view of the storage box of the present invention, according to said second embodiment.

A second embodiment of the storage box of the present invention is shown in FIGS. 11 and 12. The main difference between this second embodiment with respect to the first embodiment previously described in its lid, that is formed by two hinged sectors 102*a* and 102*b* and complementary to each other. These sectors 102*a*, 102*b* comprise complementary flaps 121*a*, 121*b* that permit to close the lid without any addition closing elements, such as e.g. without adhesive tape.

The lid also comprises additional flaps 122 that are folded below said sectors 102*a*, 102*b*. It is illustrated in FIG. 12, that the complimentary flap 121*a* is disposed between two side regions, so as to extend inwardly to form a recess. The complimentary flap 121*b* is positioned between two side regions, extending outwardly therefrom to form a projection. It is also shown in FIG. 12, that the complimentary flap 121*a* is formed with a pair of spaced grooves extending from a level of the recess. The complimentary flap 121*b* is formed with a pair of spaced grooves extending from a level of the side regions. It is also illustrated in FIG. 12 that the box is made from corrugated cardboard. The channels of the corrugated cardboard are oriented in the vertical direction on the opposed faces 105, 106 and lower face 104.

In FIG. 11 it can be seen how the sectors 101*a*, 101*b*, 101*c*, 101*d* that form the opposed face of the lid, in this case the bottom 101, are placed.

Furthermore, two opposed faces 105, 106 comprise handle-like holes 126 to facilitate the manual handling of the box.

In FIG. 12 it can be seen that the lid also comprises adhesives 121*c*, preferably double-faced adhesive tape, that reinforce the closing of the lid and prevent any accidental opening of the lid.

Figure 13:
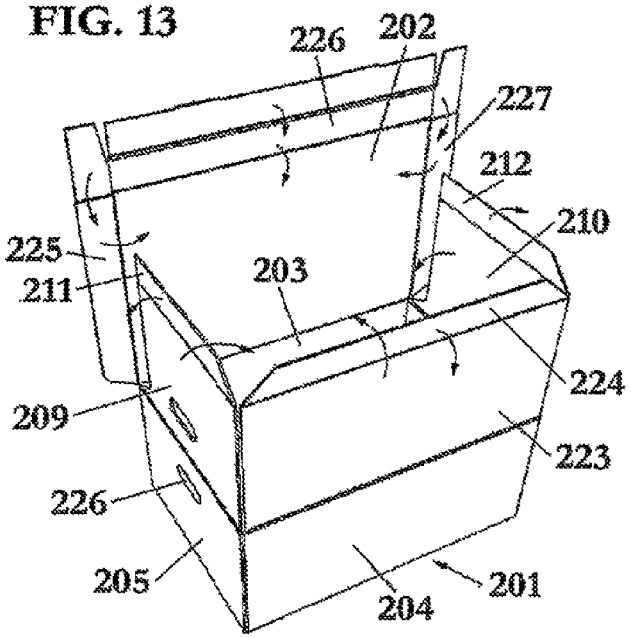
FIG. 13 is a perspective view of the storage box of the present invention partially unfolded, according to a third embodiment.
Figure 14:
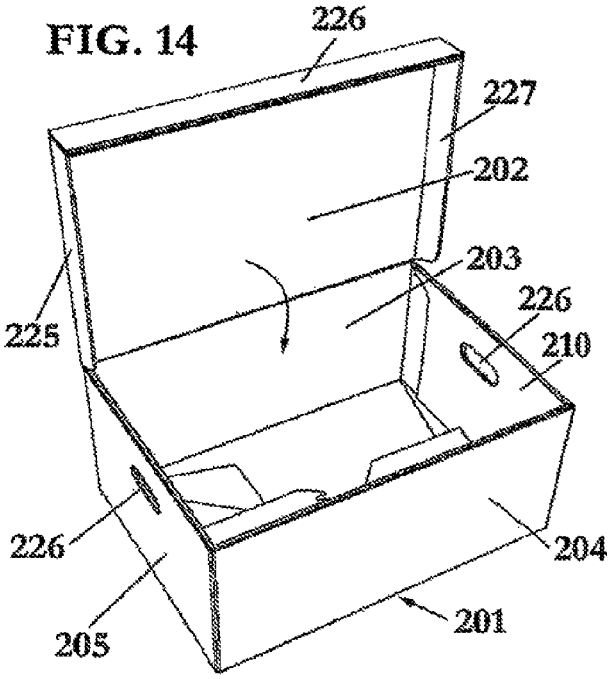
FIG. 14 is a perspective view of the storage box of the present invention with the lid opened, according to a third embodiment.

In FIG. 13 it is shown a third embodiment of the storage box of the present invention.

In this case, the opposed face (or bottom) 201 with respect to the lid is exactly the same to those described regarding the first and second embodiments.

In this embodiment the lid comprises several reinforcing flaps 225, 226, 227 placed around it. One of these flaps 226 is double, such as it is shown in FIG. 13.

The box according to this embodiment also comprises three reinforcing sectors 209, 210, 223 equivalent to the reinforcing sectors described in the first embodiment. These reinforcing sectors 209, 210, 223 are folded on the respective faces, and comprise flaps 211, 212, 224, that in the mounting position are placed on the bottom 201.

Even though reference is made to a specific embodiment of the invention, it is apparent for a person skilled in the art that the storage box described is susceptible of numerous variations and modifications, and that all the details cited can be substituted by other technically equivalent ones, without departing from the scope of protection defined by the attached claims.

What is claimed is:

1. A storage box comprising:

a single sheet of corrugated material provided with a plurality of reinforcing channels extending through the single sheet in one direction and folding lines defining a parallelepiped containing six faces and one or more protrusions that extend away from at least one of the six faces, the six faces comprising:

a hinged lid that includes:

a first lid sector hingedly connected, along a first folding line, to a first face of the six of faces; and a second lid sector hingedly connected, along a second folding line, to a second face of the six faces, opposite the first face; and a third face opposed to the hinged lid that so that the hinged lid and the first face define opposite side faces of the storage box when the storage box is disposed in a use position and at least the first face and the second face extend therebetween, wherein, when the storage box is in the use position, the one or more protrusions extend substantially perpendicularly away from one of the first face and the second face so that the one or more protrusions extend upwards and are configured to removably couple the storage box to a second box stacked atop the storage box in a manner that leaves the hinged lid accessible.

2. The storage box according to claim 1, wherein the first sector has a trapezoidal shape, with an oblique folding line that defines two triangular zones.

3. The storage box according to claim 1, wherein the second sector has a substantially rectangular shape, with an oblique folding line that defines a triangular zone and a trapezoidal zone.

4. The storage box according to claim 1, wherein the third sector has a trapezoidal shape, with an oblique folding line that defines two triangular zones.

5. The storage box according to claim 1, wherein the fourth sector has a trapezoidal shape.

6. The storage box according to claim 1, wherein at least two of the six faces comprise reinforcing sectors that are folded on the at least two faces.

7. The storage box according to claim 6, wherein the six faces further comprise:

two additional side faces extending between the third face and the hinged lid when the storage box is in the use position, and the two additional side faces include the reinforcing sectors.

8. The storage box according to claim 6, wherein each of the reinforcing sectors comprises flaps that contact the third face when the storage box is fully assembled.

9. The storage box according to claim 1, wherein one of the first lid sector and the second lid sector comprises a closing flap that is configured to selectively engage a complementary groove provided at the other of the of the first lid sector and the second lid sector.

10. The storage box according to claim 9, wherein the closing flap comprises a folding line that divides the closing flap into two halves.

11. The storage box according to claim 10, wherein one of the two halves of the closing flap comprises a protrusion that is housed into an additional groove included in the first lid sector or the second lid sector that includes the complementary groove.

12. The storage box according to claim 1, wherein one of the six faces comprises a joining flap that is joined to an upper part of an adjacent face when the storage box is in the use position.

13. The storage box according to claim 1, wherein the one or more protrusions are housed in complementary recesses of the second box when the second box is stacked atop the storage box.

14. The storage box according to claim 1, wherein the material is cardboard and the one direction is oriented so that the channels extend in a vertical direction when the reusable storage box is in its use position.

15. The storage box according to claim 1, wherein the first lid sector and the second lid sector comprise complementary flaps.

16. The storage box according to claim 1, wherein the box comprises reinforcing flaps around the hinged lid.

17. The storage box according to claim 16, wherein the reinforcing flaps contact the third face when the storage box is fully assembled.

18. A reusable storage box, comprising:

a plurality of faces formed from a single sheet of corrugated material that is provided with a plurality of reinforcing channels extending through the single sheet in one direction, the plurality of faces including:

an upper face that is disposed at a top of the reusable storage box when the reusable storage box is in a use position;

a first face that comprises:

a first sector with an oblique folding line defining a first joining zone; and a second sector joined to the first sector at the first joining zone; and a lid configured to define a side face of the reusable storage box when the reusable storage box is in the use position, the lid comprising:

a first lid sector hingedly connected, along a first folding line, to a first side face of the plurality of faces defining the reusable storage box; and a second lid sector hingedly connected, along a second folding line, to a second side face of the plurality of faces defining the reusable storage box, wherein at least one of the first lid sector and the second lid sector comprises at least one engaging groove for engaging the first lid sector and the second lid sector to each other; and at least one protrusion extending substantially perpendicularly with respect to the upper face so that the at least one protrusion is configured to removably couple the reusable storage box to a second box stacked atop the reusable storage box when the reusable storage box is in the use position.

* * * * *